US010702014B2

(12) United States Patent
Stasey

(10) Patent No.: US 10,702,014 B2
(45) Date of Patent: Jul. 7, 2020

(54) NITINOL-DRIVEN BOTTOM OF FOOT COMPRESSION SYSTEM

(71) Applicant: Brian Stasey, Fishers, IN (US)

(72) Inventor: Brian Stasey, Fishers, IN (US)

(73) Assignee: Brian J Stasey, Fishers, IN (US)

( * ) Notice: Subject to any disclaimer, the term of this patent is extended or adjusted under 35 U.S.C. 154(b) by 120 days.

(21) Appl. No.: 16/037,498

(22) Filed: Jul. 17, 2018

(65) Prior Publication Data

US 2019/0021442 A1 Jan. 24, 2019

Related U.S. Application Data

(60) Provisional application No. 62/533,804, filed on Jul. 18, 2017.

(51) Int. Cl.

| | |
|---|---|
| ***A43B 13/18*** | (2006.01) |
| ***A43B 17/14*** | (2006.01) |
| ***A43B 3/00*** | (2006.01) |
| ***A43B 7/14*** | (2006.01) |
| ***A43B 7/04*** | (2006.01) |
| *A43B 13/12* | (2006.01) |

(52) U.S. Cl.

CPC ..... *A43B 13/187* (2013.01); *A43B 3/0005* (2013.01); *A43B 7/04* (2013.01); *A43B 7/14* (2013.01); *A43B 17/14* (2013.01); *A43B 13/122* (2013.01)

(58) Field of Classification Search

CPC ..... A43B 13/187; A43B 7/04; A43B 7/14; A43B 13/122; A43B 3/005; A43B 5/00; A43B 5/04; A43B 5/0435; A43B 5/0443; A43B 5/0447; A43B 5/0441

See application file for complete search history.

(56) References Cited

U.S. PATENT DOCUMENTS

| | | | | |
|---|---|---|---|---|
| 5,311,678 | A * | 5/1994 | Spademan | A43B 5/00 36/114 |
| 6,598,322 | B2 * | 7/2003 | Jacques | A43B 3/0005 36/127 |
| 2005/0188566 | A1 * | 9/2005 | Whittlesey | A43B 3/0005 36/127 |
| 2010/0154255 | A1 * | 6/2010 | Robinson | A43B 3/0005 36/127 |
| 2016/0309834 | A1 * | 10/2016 | Zwick | A43B 23/029 |
| 2016/0374886 | A1 * | 12/2016 | Wyatt | A61N 1/36014 601/18 |
| 2017/0252252 | A1 * | 9/2017 | Wyatt | A61H 1/008 |
| 2019/0017199 | A1 * | 1/2019 | Granberry | D04B 1/26 |

FOREIGN PATENT DOCUMENTS

| | | | | |
|---|---|---|---|---|
| EP | 0186197 | A1 * | 7/1986 | A43C 11/008 |
| EP | 0321714 | A2 * | 6/1989 | A43B 3/0005 |
| FR | 2645720 | A1 * | 10/1990 | A43B 5/0449 |

* cited by examiner

*Primary Examiner* — Christopher R Harmon

(57) ABSTRACT

Compression of venous tissue enables improved blood flow in the feet. For example, nitinol wire wrapped around a curved footbed is electrically heated and thus shrinks forcing the wire on the top of the footbed into the bottom of the foot. The wire, or group of wires, is successively withdrawn and re-pressed against the bottom of the foot from toe to heel. Athletic recovery and treatment of various medical conditions may be achieved, for example restless leg syndrome, edema, plantar fasciitis, deep vein thrombosis, pulmonary embolism, venous insufficiency, wound care, and the like.

1 Claim, 5 Drawing Sheets

NITINOL-DRIVEN BOTTOM OF FOOT COMPRESSION SYSTEM

The present disclosure generally relates to athletic recovery and medical care, specifically to a system for compressing the bottom of the foot to treat a medical condition or aid athletic recovery.

BACKGROUND

To enhance circulation in a person's feet, periodic or cyclic compression of tissue, such as the plexus regions of the foot, at predetermined timed intervals is beneficial. Under normal circumstances, blood moves up the legs due to muscle contraction and general movement of the feet or legs, such as when walking. If a person is immobilized, or has poor circulation brought on by disease, the natural blood return mechanism is impaired, and circulatory problems such as ulcers, deep vein thrombi, and pulmonary emboli can occur.

To mitigate these problems, it is desirable to concentrate a compressive force against veins in the feet. Current systems are primarily based on pneumatic compression devices that squeeze the calf.

In various current devices, tethered air lines limit mobility. Users cannot walk with them.

DETAILED DESCRIPTION

A foot compression system comprises a tissue depressing nitinol wire or set of wires. In various examples, foot compression system 100 in FIG. 1 comprises a footbed that has rigid edges around the perimeter of the foot 100C that curve up to cradle the foot and provide support. The edges of the footbed where a lifter is to be mounted must have a suitable strength and rigidity to support the amount of force the lifter is designed to impart into the bottom of the foot. The higher the curve reaches up on the foot, the higher the lifter can be brought into the fascia. Lifter 100A is a length of nitinol wire that is wrapped around the top and bottom of the curved footbed. Both ends of the nitinol wire are anchored 100B on the bottom side of the footbed. One end of the nitinol wire is attached to a positively charged lead wire and the other end is attached to a ground wire. These positive and ground wires are attached to a micro-controller that can turn electrical power on and off to cause the nitinol wire to shrink by about 4.5% lengthwise as it heats through its transition temperature. This causes the nitinol wire on the top side of the foot bed to lift the portion of the foot that is resting on it. This lifting action can cause the lifter to push into the fascia on the bottom of the foot from 5 mm to 25 mm with a force from 5 Newtons to 50 Newtons above each lifter. A footbed can have from one to as many lifters as is practical to fit on the footbed. A typical number of lifters could be six.

Figure 1:
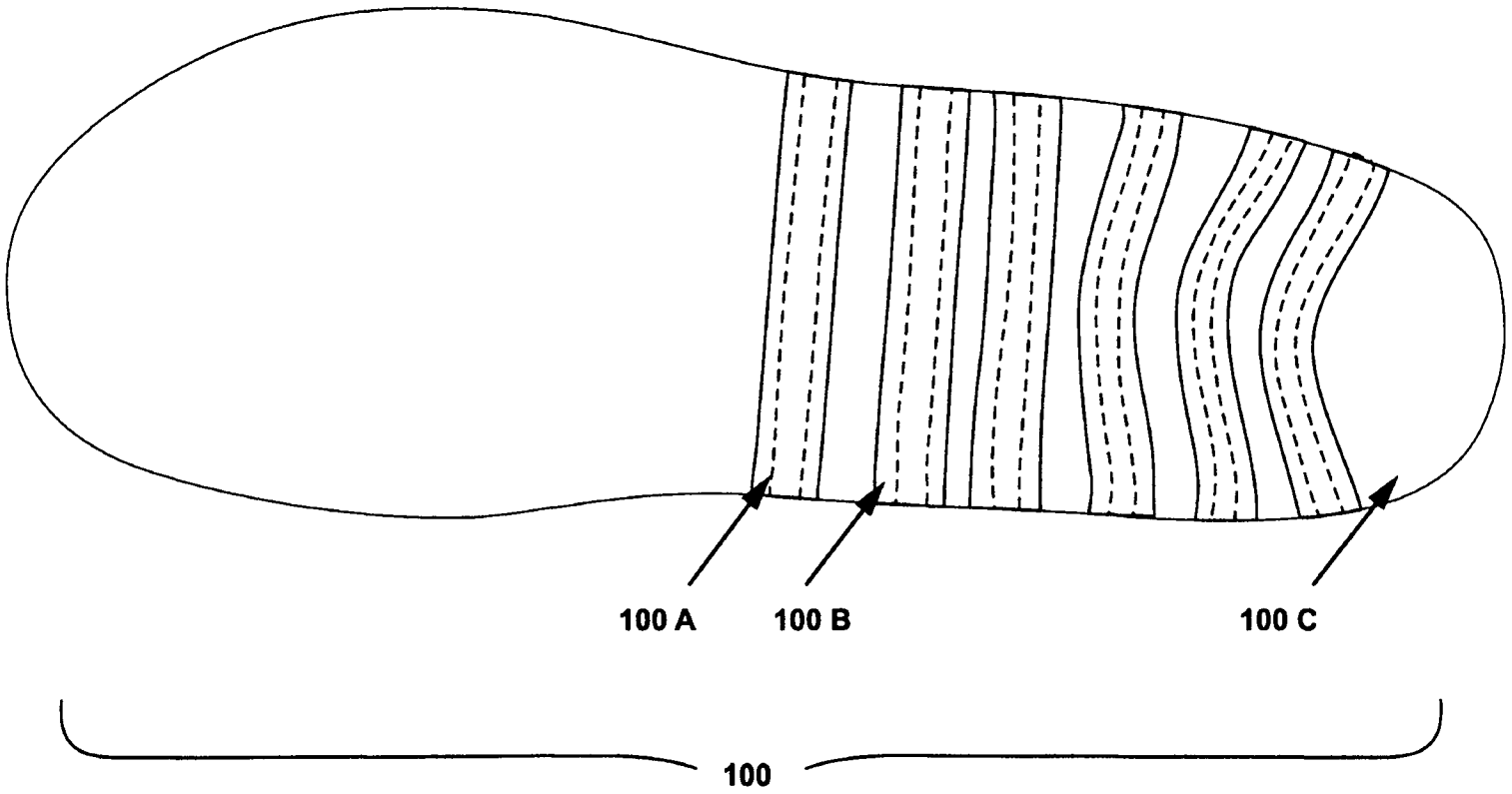
FIG. 1 illustrates a nitinol driven foot compression system example

FIG. 1 shows a footbed with six lifters mounted on the back half of the footbed closest to the heel. During operation the lifter closest to the front of the footbed is energized first with an on-time of between 2 s and 4 s. Shortly after that the next most forward lifter can be energized, then the next most forward lifter and so on, all the way to the sixth lifter. This provides a rhythmic pumping action as the lifters force themselves into the venous plexus region of the foot. Preliminary doppler velocimeter readings on the popliteal vein have shown blood flow speeds increasing during actuation by 400% or more through this action.

Figure 2:
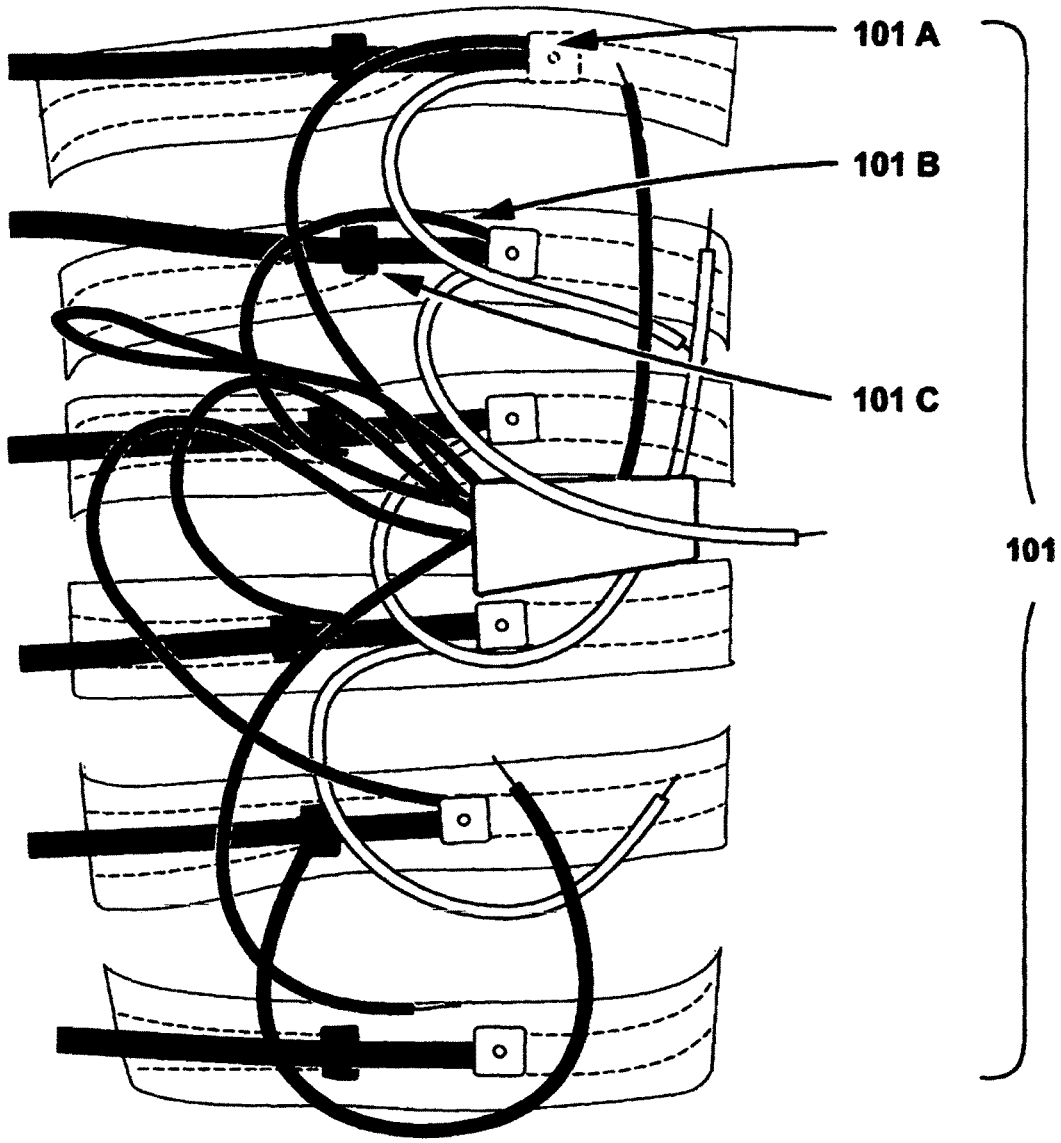
FIG. 2 illustrates the bottom view of the nitinol driven foot compression example

FIG. 2 shows typical lifter 101A is comprised of 12" of 0.010" diameter Flexinol HT or LT wire. The wire is doubled back on itself in a loop and crimped to power lead wires. The doubled back loop of wire is covered in a thin 1 mil or 2 mil Teflon/silicone conforming tape to provide waterproofing, to protect the user from heat, and to protect the user from the electrical current used to drive the nitinol wire past its transition temperature of between 160 F to 180 F. The lifters can be further embedded into the foot bed and covered with a high temperature polyester fabric. The user can feel warmth from the wires but is never exposed to temperatures above 104 F. The temperature is controlled by the on time of the current to the lifter which varies depending on the effect, the controller is imparting to the user's foot. A higher voltage will cause the onset of the compression to be faster.

Lifters may be designed to be adjustable 101C. Example 101C has a mechanism like a zip tie that allows the top portion of the lifter to be adjusted to provide more or less initial contact with the bottom of the foot. Flexinol wire is stretchy and thus if the lifter is tightened such that it is floating just above the footbed, the action of putting the weight of the foot onto the footbed can provide some preload to the nitinol wire increasing its ability to impart force into the bottom of the foot. Point 101C shows the looped end of the nitinol wire being held by a catchment in the adjustment mechanism while 101B shows the that the two ends of the nitinol wire are crimped to power lead wires and attached to the opposite end of the adjustment mechanism.

Figure 3:
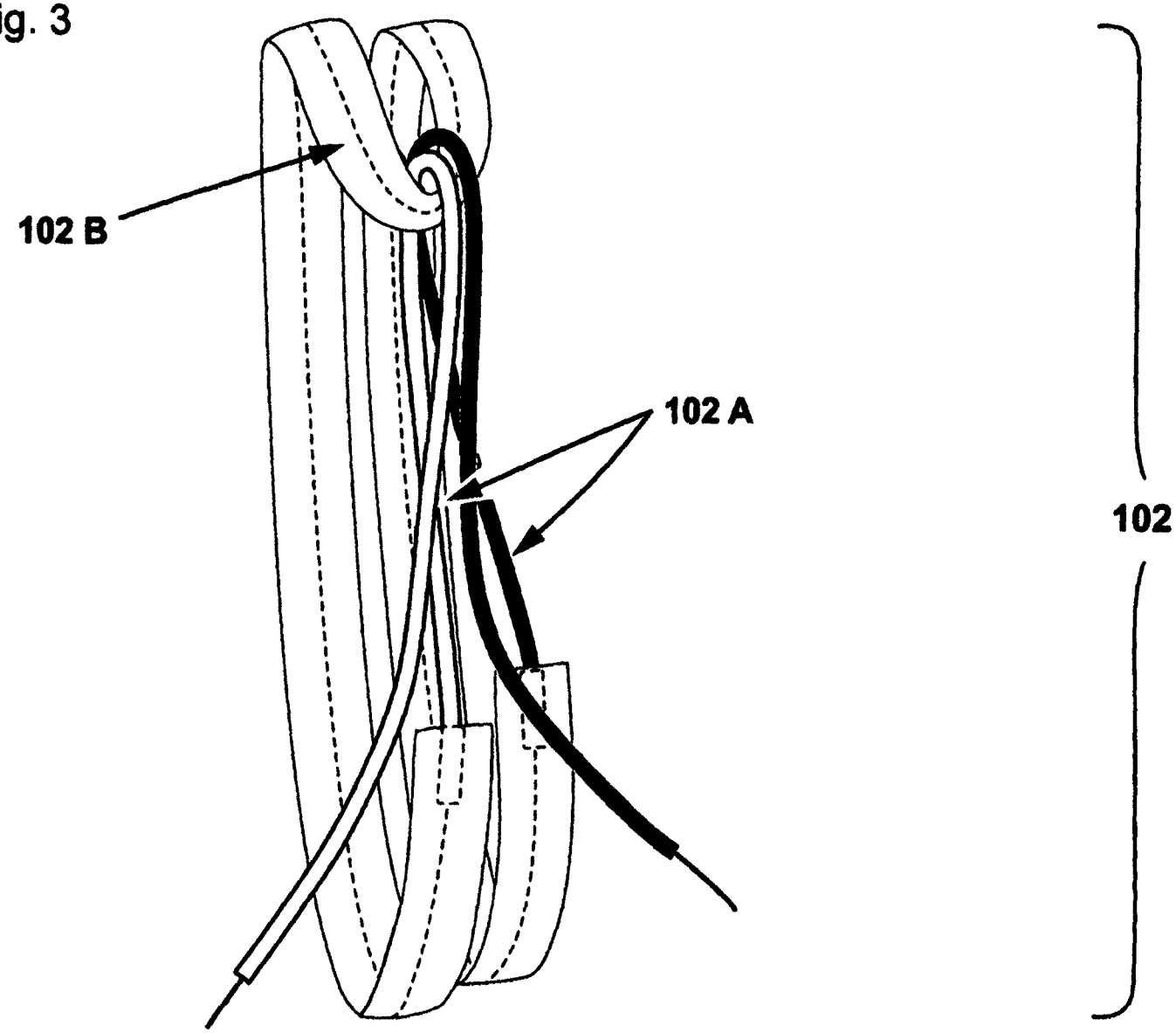
FIG. 3 illustrates a foot lifter example mechanism

FIG. 3 shows a close-up view of a lifter not mounted on an insole. 102A shows an embodiment whereby the power wires are glued to themselves providing a simple manufacture method. The lifter can be easily slid onto the insole. 102B demonstrated the Nitinol wire (dashed line) encapsulated in Teflon-silicone tape.

Figure 4:
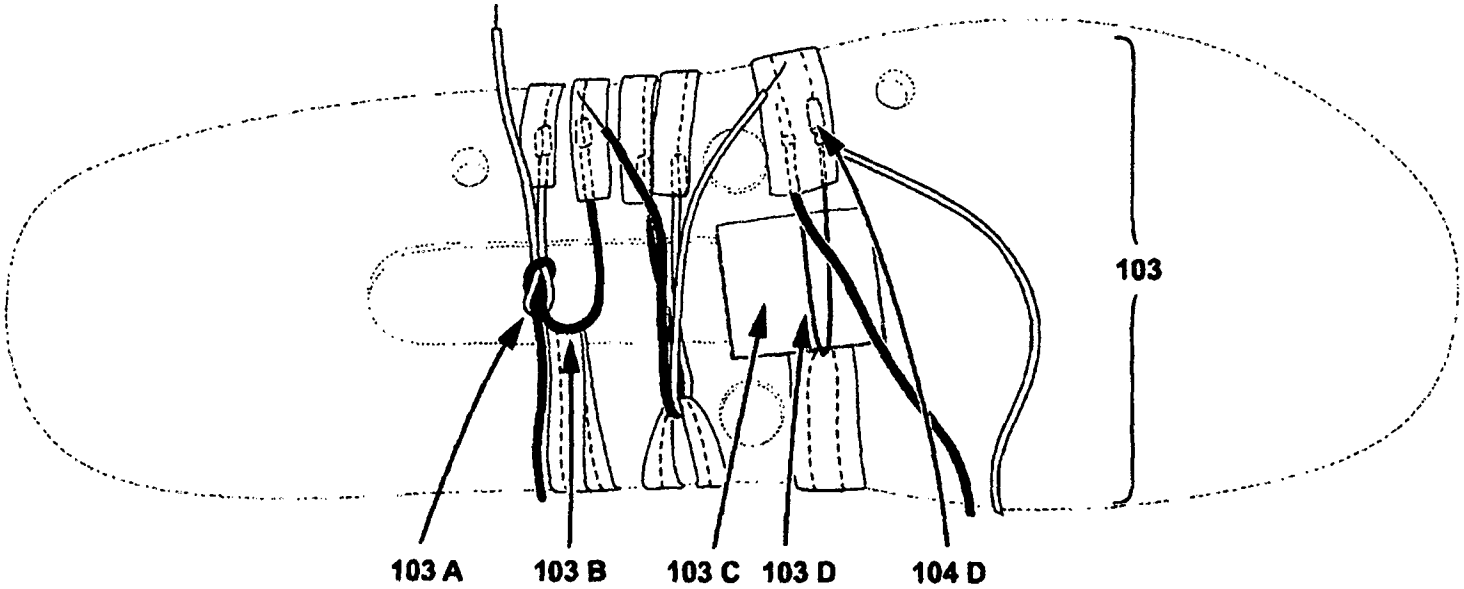
FIG. 4 illustrates three examples of foot lifter mechanisms on a typical footbed

FIG. 4 shows three different embodiments of lifters mounted on an insole. 103A shows an example whereby the power wires are simply knotted providing for a very simple and inexpensive manufacturing method.

103D shows a lifter that has a piece of Kevlar or other strong string crimped into the electrical crimp, then the wire is looped into the nitinol loop providing a catchment point. The length of Kevlar string 104D may be wrapped around an object 103C to vary its length and thus change the amount of pre-tension on the nitinol wire.

Figure 5:
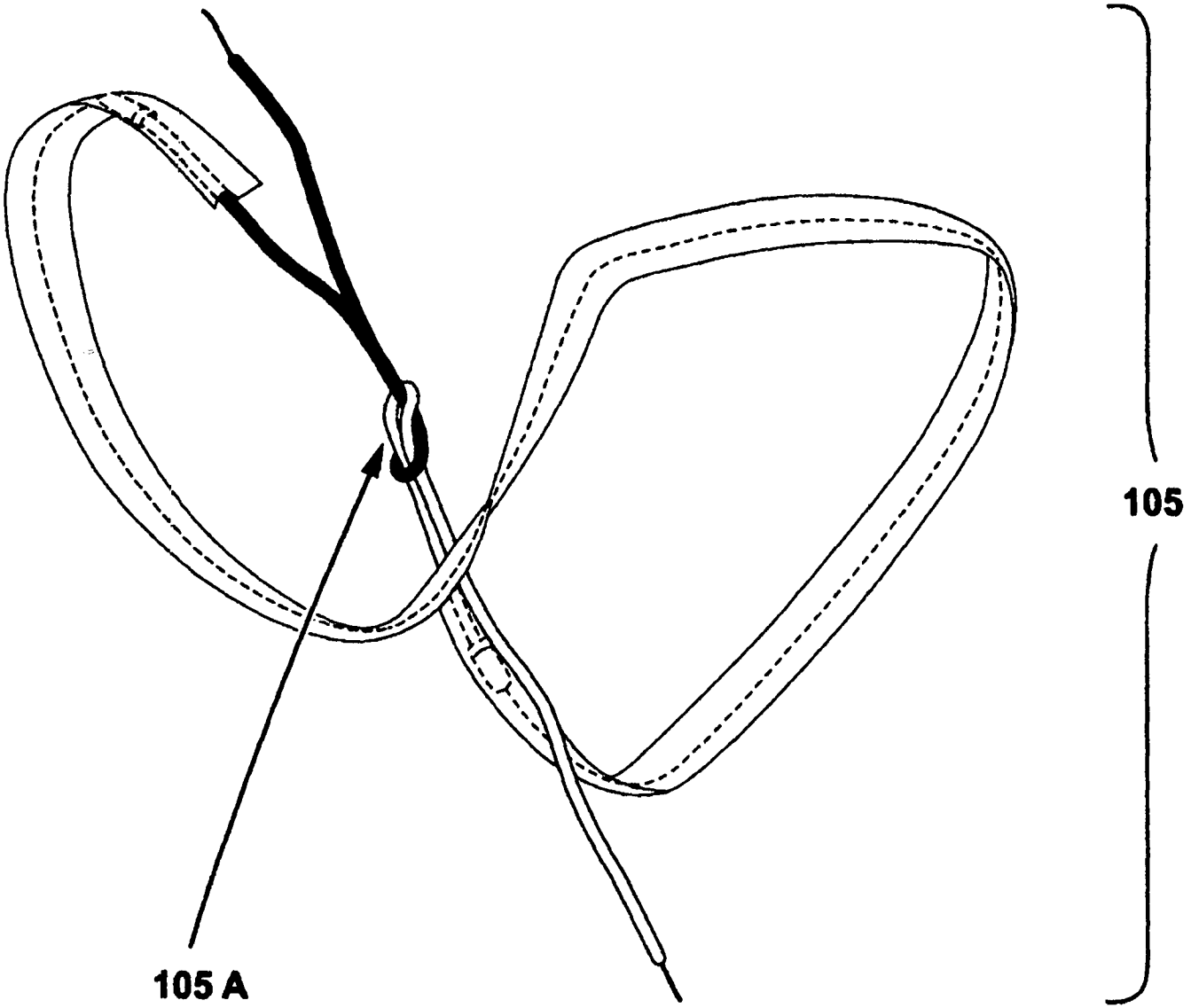
FIG. 5 illustrates an alternative foot lifter example mechanism

FIG. 5 shows another embodiment of a lifter that is created as a loop of nitinol crimped to electrical wires and formed into a loop with a knot. The loop is then folded in on itself and can be wrapped around a footbed providing another simple method of manufacture of the lifter.

Nitinol-Driven Bottom of Foot Compression System is configured to be inserted into normal, off-the-shelf shoes, sandals, and other footwear and can replace the insole of a traditional athletic shoe.

What is claimed is:

1. A foot compression system adapted to be mounted in a footwear item having a footbed extending in a nominal plane and having opposed sides with rigid edges extending upwardly with respect to the nominal plane from the perimeter of the footbed, comprising:

at least one SMA wire segment formed in a loop around the footbed under the foot with the upper portion of the loop suspended over the footbed by the opposed side edges, and the lower portion of loop looping under the footbed; the shrinkage of the wire loop forcing the upper portion of the loop between the foot and the footbed to become rigidly suspend across the opposed edges and the wire becoming forced into the bottom of the foot;

connection means for electrically connecting said at least one SMA wire segment through a controller to a power supply to selectively and reiteratively conduct electrical power to said at least one SMA wire segment and cause said segment to be heated beyond its threshold temperature and contract;

said loop portion being urged into the bottom of a foot supported on said footbed when said segment contracts;

further including a plurality of said SMA wire segments with said loop portions thereof being spaced apart along and arrayed along said opposed rigid edges;

wherein said controller is programmed to actuate said plurality of SMA wire segments individually in a predetermined sequence.

* * * * *